US010344764B2

(12) United States Patent
Nakamura et al.

(10) Patent No.: US 10,344,764 B2
(45) Date of Patent: Jul. 9, 2019

(54) AXIAL BLOWER AND SERIES-TYPE AXIAL BLOWER

(71) Applicant: SANYO DENKI CO., LTD., Tokyo (JP)

(72) Inventors: Toshiyuki Nakamura, Tokyo (JP); Shuji Miyazawa, Tokyo (JP)

(73) Assignee: SANYO DENKI CO., LTD., Tokyo (JP)

( * ) Notice: Subject to any disclaimer, the term of this patent is extended or adjusted under 35 U.S.C. 154(b) by 282 days.

(21) Appl. No.: 15/236,520

(22) Filed: Aug. 15, 2016

(65) Prior Publication Data

US 2017/0051747 A1 Feb. 23, 2017

(30) Foreign Application Priority Data

Aug. 18, 2015 (JP) ..... 2015-161276

(51) Int. Cl.
*F04D 25/06* (2006.01)
*F04D 29/38* (2006.01)
(Continued)

(52) U.S. Cl.
CPC ..... *F04D 25/06* (2013.01); *F04D 19/007* (2013.01); *F04D 25/0613* (2013.01);
(Continued)

(58) Field of Classification Search
CPC ..... F04D 25/06; F04D 29/181; F04D 29/002; F04D 29/522; F04D 29/646;
(Continued)

(56) References Cited

U.S. PATENT DOCUMENTS 6,428,277 B1 8/2002 Holmes
6,994,523 B2 * 2/2006 Eguchi ..... F04D 29/384 416/228
(Continued)

FOREIGN PATENT DOCUMENTS

CN 1971065 A 5/2007
CN 103671255 A 3/2014
(Continued)

OTHER PUBLICATIONS

Notice of Reason for Refusal for Japanese Patent Application No. 2015-161276 dated Nov. 24, 2015.
(Continued)

*Primary Examiner* — Charles Freay
*Assistant Examiner* — Lilya Pekarskaya
(74) *Attorney, Agent, or Firm* — Rankin, Hill & Clark LLP

(57) ABSTRACT

An axial blower includes: a housing including a wind tunnel; an impeller that is disposed in the wind tunnel and includes a plurality of blades; and a motor that includes a rotation shaft and is secured to the housing, the impeller being secured to the rotation shaft. When an angle between a chord of the blade at a cross-sectional surface of the blade cut by a virtual cylindrical surface centering the rotation shaft, and a surface perpendicular to the rotation shaft is defined as a mounting angle, the blade includes an intermediate part between an inside diameter side part and an outside diameter side part of the blade, and this intermediate part has a mounting angle equal to or larger than a mounting angle of the inside diameter side part, and larger than a mounting angle of the outside diameter side part.

3 Claims, 11 Drawing Sheets

(51) Int. Cl.

| | |
|---|---|
| ***F04D 29/00*** | (2006.01) |
| ***F04D 29/18*** | (2006.01) |
| ***F04D 29/52*** | (2006.01) |
| ***F04D 19/00*** | (2006.01) |

(52) U.S. Cl.
CPC ..... *F04D 29/002* (2013.01); *F04D 29/181* (2013.01); *F04D 29/384* (2013.01); *F04D 29/522* (2013.01); *F05D 2240/304* (2013.01)

(58) Field of Classification Search
CPC .... F04D 29/384; F04D 25/166; F04D 29/325; F04D 19/002
USPC ..... 416/223 R, 242, 243
See application file for complete search history.

(56) References Cited

U.S. PATENT DOCUMENTS

| | | | | |
|---|---|---|---|---|
| 7,029,229 | B2 * | 4/2006 | Iwase | F04D 29/384 415/1 |
| 8,348,593 | B2 | 1/2013 | Yoshida | |
| 8,764,375 | B2 | 7/2014 | Otsuka | |
| 8,770,943 | B2 * | 7/2014 | Ishihara | F04D 25/0613 416/235 |
| 8,911,215 | B2 * | 12/2014 | Cornelius | F01D 5/141 416/242 |
| 2004/0253103 | A1 | 12/2004 | Sugimura | |
| 2007/0059155 | A1 | 3/2007 | Ishihara et al. | |
| 2008/0219849 | A1 | 9/2008 | Balan | |
| 2009/0047118 | A1 | 2/2009 | Ishihara et al. | |
| 2011/0142611 | A1 * | 6/2011 | Kato | F04D 19/002 415/206 |
| 2014/0086754 | A1 | 3/2014 | Seiji et al. | |

FOREIGN PATENT DOCUMENTS

| | | | |
|---|---|---|---|
| EP | 0259061 | A2 | 3/1988 |
| EP | 2336576 | A2 | 6/2011 |
| JP | 6361800 | | 3/1988 |
| JP | 8284887 | | 10/1996 |
| JP | 2003065295 | A2 | 3/2003 |
| JP | 2004332674 | A2 | 11/2004 |
| JP | 2011144804 | A2 | 7/2011 |
| JP | 5210852 | | 6/2013 |
| JP | 5273475 | | 8/2013 |
| WO | 2008065985 | A1 | 6/2008 |
| WO | 2008109037 | A1 | 9/2008 |
| WO | 2014141417 | A1 | 9/2014 |

OTHER PUBLICATIONS

European Search Report dated Jan. 9, 2017 for the corresponding European Patent Application No. 16183444.5.
Office Action dated Mar. 25, 2019 for the corresponding Chinese Patent Application No. 201610649582.5.

* cited by examiner

AXIAL BLOWER AND SERIES-TYPE AXIAL BLOWER

CROSS-REFERENCE TO RELATED APPLICATION

This application claims priority from Japanese Patent Application No. 2015-161276 filed with the Japan Patent Office on Aug. 18, 2015, the entire content of which is hereby incorporated by reference.

BACKGROUND

1. Technical Field

This disclosure relates to an axial blower and a series-type axial blower.

2. Description of the Related Art

An axial blower disclosed in the description in Japanese Patent No. 5210852 has a motor incorporated in an impeller including a plurality of blades. A serial axial blower disclosed in the description in Japanese Patent No. 5273475 (the description in U.S. Pat. No. 8,348,593) includes a first axial fan and a second axial fan coupled to the first axial fan.

SUMMARY

An axial blower includes: a housing including a wind tunnel; an impeller that is disposed in the wind tunnel and includes a plurality of blades; and a motor that includes a rotation shaft and is secured to the housing, the impeller being secured to the rotation shaft. When an angle between a chord of the blade at a cross-sectional surface of the blade cut by a virtual cylindrical surface centering the rotation shaft, and a surface perpendicular to the rotation shaft is defined as a mounting angle, the blade includes an intermediate part between an inside diameter side part and an outside diameter side part of the blade, and this intermediate part has a mounting angle equal to or larger than a mounting angle of the inside diameter side part, and larger than a mounting angle of the outside diameter side part.

DESCRIPTION OF THE EMBODIMENTS

Figure 1A:
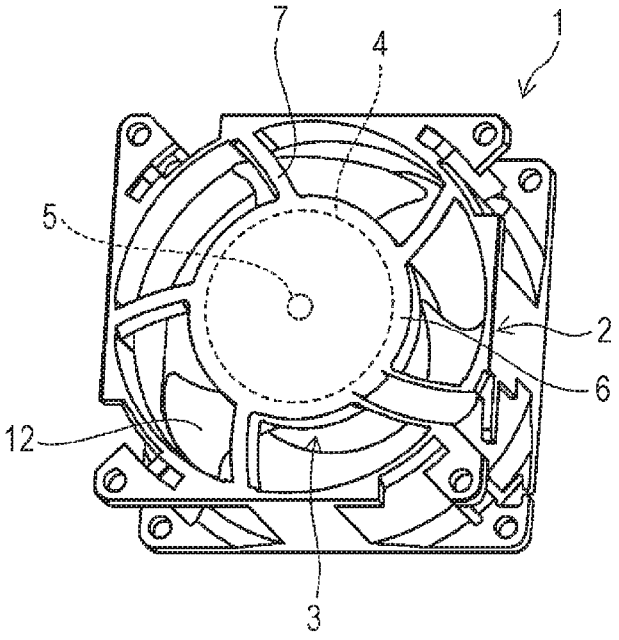
FIG. 1A is a front side perspective view of an axial blower of a first embodiment.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

A blade described in the description in Japanese Patent No. 5210852 includes an inverse curving portion. The inverse curving portion is disposed at an area near a distal end portion of the blade. This area is positioned opposed to a base portion in a radial direction of a peripheral wall portion of a hub. The inverse curving portion becomes convex toward a rotation direction, and becomes concave toward a direction opposite to the rotation direction. The inverse curving portion extends along the distal end portion of the blade. In a technique described in the description in Japanese Patent No. 5210852, an outline shape of a back end edge of the blade is curved at a position corresponding to the inverse curving portion (for example, in FIG. 3 in the description in Japanese Patent No. 5210852). The description in Japanese Patent No. 5210852 discloses that the above-described configuration "can decrease a dropping amount at an inflection point that appears in air volume-static pressure characteristics and reduce noise more than ever before" as an action and an advantageous effect. However, in the past, a configuration of the blade to reduce power consumption has not been sufficiently examined.

At a blade described in the description in Japanese Patent No. 5273475 (for example, in FIG. 5), an outside part in a radial direction is more perpendicular than an inside part. This gradationally and slightly increases an angle between a blade chord of the blade and a rotation surface of an impeller, toward an outward in the radial direction. The description in Japanese Patent No. 5273475 discloses that the above-described configuration "improves static pressure-air volume characteristics" (for example, in FIG. 6) as an action and an advantageous effect. However, even in the description in Japanese Patent No. 5273475, the blade configuration to reduce the power consumption is not sufficiently examined.

Therefore, one purpose of this disclosure is to provide an axial blower and a series-type axial blower that can reduce the power consumption while maintaining cooling performance equal to that of the conventional one.

An axial blower according to an embodiment of the present disclosure (the present axial blower) includes: a housing including a wind tunnel; an impeller that is disposed in the wind tunnel and includes a plurality of blades; and a motor that includes a rotation shaft and is secured to the housing, the impeller being secured to the rotation shaft. When an angle between a chord of the blade at a cross-sectional surface of the blade cut by a virtual cylindrical surface centering the rotation shaft, and a surface perpendicular to the rotation shaft is defined as a mounting angle, the blade includes an intermediate part between an inside diameter side part and an outside diameter side part of the blade, and this intermediate part has a mounting angle equal to or larger than a mounting angle of the inside diameter side part, and larger than a mounting angle of the outside diameter side part.

In the present axial blower, the blade may include a rear edge having a cutout shape, and the intermediate part may include a part where a length of the chord is 80% or less than a length of the chord of the outside diameter side part.

Further, in the present axial blower, the intermediate part may include a part where the length of the chord is 72% to 75% of the length of the chord of the outside diameter side part.

A series-type axial blower according to an embodiment of the present disclosure (the present series-type axial blower) includes a plurality of the present axial blowers which are coupled in series in an axial direction of the rotation shaft.

In the present series-type axial blower, the mounting angle of the intermediate part at the axial blower disposed at an air intake side may be larger than the mounting angle of the intermediate part at the axial blower disposed at a discharge side.

The present axial blower can reduce the power consumption while maintaining the cooling performance equal to that of the conventional one. Further features regarding technique of this disclosure will be apparent from description of this description and attached drawings. Configuration and advantageous effect other than the above-described one will be apparent from following explanation of embodiments.

The following describes embodiments of this disclosure with reference to the attached drawings. The attached drawings illustrate specific embodiments in accordance with principle of the technique of this disclosure. These attached drawings are illustrated for understanding this disclosure, and are never used for interpreting the technique of this disclosure in a limited way.

In the following explanation of the embodiments, positional relationships and directions of respective members may be illustrated by using expressions such as upper and lower, front and rear, and right and left. These expressions merely illustrates only the positional relationships and the directions of the respective members in the drawings, and do not illustrate the positional relationships and the directions of the respective members when being incorporated in actual equipment.

First Embodiment

Figure 1B:
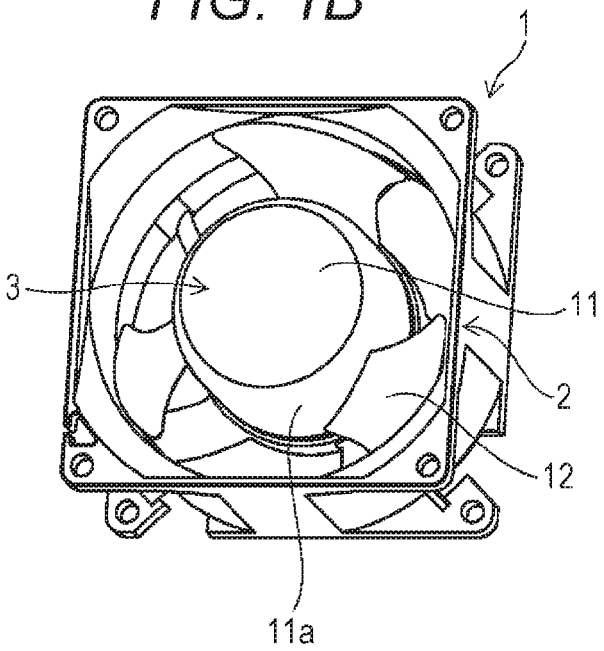
FIG. 1B is a back side perspective view of the axial blower of the first embodiment.

The following describes an axial blower according to a first embodiment of this disclosure with reference to the drawings in detail. FIG. 1A is a front side perspective view of an axial blower 1 of the first embodiment. FIG. 1B is a back side perspective view of the axial blower 1 of the first embodiment.

The axial blower 1 includes a fan housing (housing) 2, an impeller 3 disposed in the fan housing 2, and a motor 4 (indicated by a dashed line), which rotatably drives the impeller 3. The motor 4 is incorporated in the impeller 3. The motor 4 includes a stator where a winding wire is wound, and a rotator including permanent magnets. The motor 4 includes a rotation shaft 5 (indicated by a dashed line) where the impeller 3 is secured. A motor case 6 is disposed at a center of the fan housing 2. The stator (not illustrated) of the motor 4 is secured to the motor case 6. A plurality of webs 7 extends radially from the motor case 6 to couple the fan housing 2 to the motor case 6.

Figure 2:
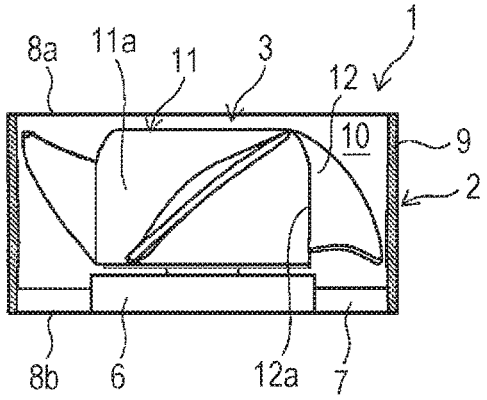
FIG. 2 is a cross-sectional view of the axial blower of the first embodiment.

FIG. 2 is a cross-sectional view of the axial blower 1 of the first embodiment. The fan housing 2 includes a pipe portion 9. The pipe portion 9 includes a suction opening 8*a* and a discharge opening 8*b*. The pipe portion 9 has an internal space that configures a wind tunnel 10. The impeller 3 rotates in the wind tunnel 10. The impeller 3 includes a hub 11 including a peripheral wall portion 11*a*, and three blades 12. A plurality of permanent magnets (not illustrated), which configures the rotator of the motor 4, is secured inside the peripheral wall portion 11*a* of the hub 11. Base portions 12*a* of the three blades 12 are secured to the peripheral wall portion 11*a* of the hub 11. The three blades 12 extend from the peripheral wall portion 11*a* of the hub 11 to an outside in a radial direction of the peripheral wall portion 11*a*. Furthermore, the three blades 12 are disposed in a circumferential direction of the peripheral wall portion 11*a* at a regular interval.

Figure 3A:
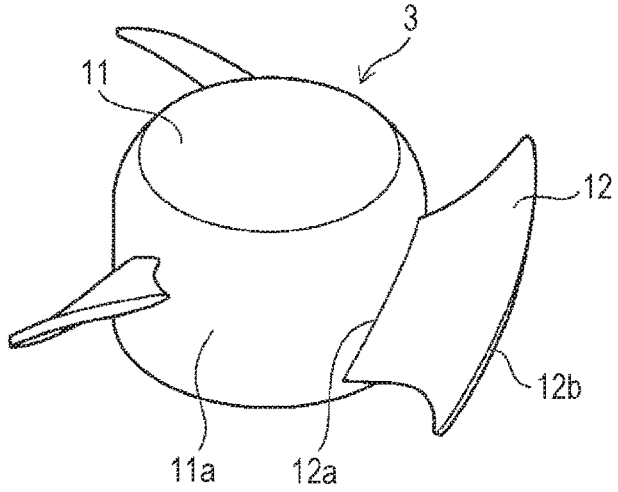
FIG. 3A is a perspective view of a first exemplary impeller in the axial blower of the first embodiment.
Figure 3B:
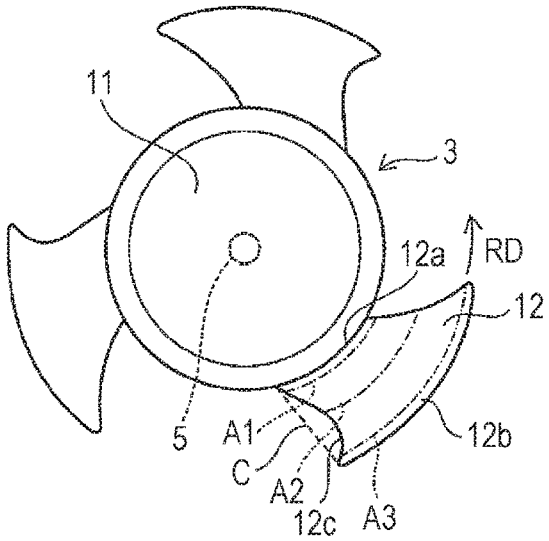
FIG. 3B is a plan view of the first exemplary impeller in the axial blower of the first embodiment.

FIG. 3A is a perspective view of a first example of the impeller 3. FIG. 3B is a plan view of the impeller 3 in FIG. 3A. Here, it is assumed that virtual circular arcs center the rotation shaft 5 of the impeller 3. Virtual circular arcs A1, A2, and A3, which are disposed from an inside diameter side to an outside diameter side of the blade 12, are defined as illustrated in FIG. 3B. That is, the virtual circular arc A1 is positioned at the inside diameter side of the blade 12. The virtual circular arc A1 is, for example, positioned at the proximity of the base portion 12*a* of the blade 12. The virtual circular arc A3 is positioned at the outside diameter side of the blade 12. The virtual circular arc A3 is, for example, positioned at the proximity of an outside-diameter-side end portion 12*b* of the blade 12. The virtual circular arc A2 is positioned between the virtual circular arc A1 and the virtual circular arc A3.

Figure 4:
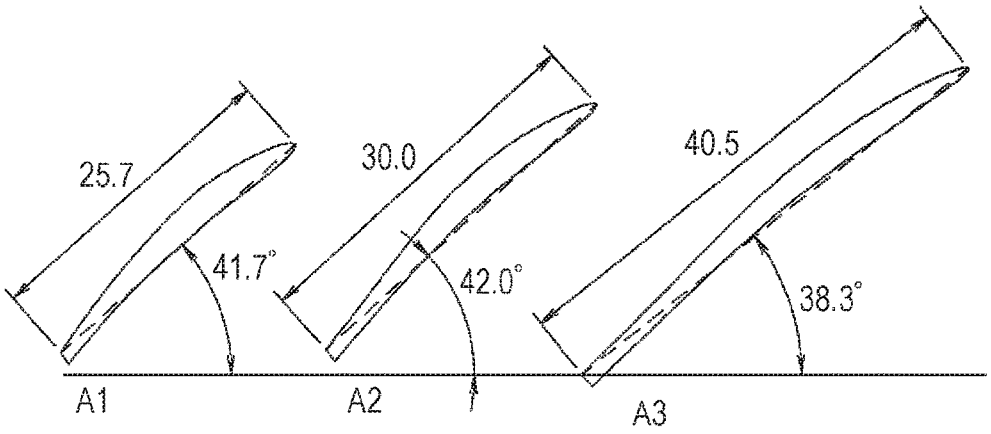
FIG. 4 are cross-sectional views of a blade cut at positions of virtual circular arcs in FIG. 3B by virtual cylindrical surfaces.

FIG. 4 are cross-sectional views of the blade 12 cut at positions of the virtual circular arcs A1 to A3 in FIG. 3B by virtual cylindrical surfaces. The cross-sectional surfaces illustrated in FIG. 4 are that cross-sectional surfaces of the blade 12 cut at the positions of the virtual circular arcs A1 to A3 by the virtual cylindrical surfaces centering the rotation shaft 5 of the impeller 3 are projected in a planar surface. Here, expressions regarding straight lines coupling front edges to rear edges at the cross-sectional surfaces of the blade 12 illustrated in FIG. 4 are defined as follows. That is, the "front edge" is an edge portion at a front side with respect to a rotation direction RD of the impeller 3, and the "rear edge" is an edge portion at a rear side with respect to the rotation direction RD of the impeller 3. In the following explanation, a straight line coupling an apex of the front edge to an upper end of the rear edge on the cross-sectional surface in FIG. 4 is referred to as a "chord". An angle between the chord of the blade 12 and a surface perpendicular to the rotation shaft 5 of the impeller 3 is defined as and referred to as a "mounting angle".

The following describes features of the blade 12 of this embodiment. The blade 12 has an intermediate part between a part at the inside diameter side and a part at the outside diameter side of the blade 12. The mounting angle of this intermediate part is equal to or larger than the mounting angle of the inside diameter side part, and larger than the mounting angle of the outside diameter side part. The above-described inside diameter side part is, for example, a part corresponding to the virtual circular arc A1. The above-described outside diameter side part is, for example, a part corresponding to the virtual circular arc A3. The above-described intermediate part is, for example, a part corresponding to the virtual circular arc A2.

For example, the mounting angle of the part corresponding to the virtual circular arc A1 of the blade 12 is referred to as a first angle. Furthermore, for example, the mounting angle of the part corresponding to the virtual circular arc A2 of the blade 12 is referred to as a second angle. Furthermore, for example, the mounting angle of the part corresponding to the virtual circular arc A3 of the blade 12 is referred to as a third angle. At this time, the blade 12 of this embodiment satisfies a following formula.

$$\text{First angle} \leq \text{Second angle, and Second angle} > \text{Third angle} \quad \text{(Formula 1)}$$

The intermediate part that satisfies the above-described (Formula 1) is not limited to the position of the virtual circular arc A2 in FIG. 3B. The intermediate part that satisfies the above-described (Formula 1), for example, may be disposed at any position between the virtual circular arc A1 and the virtual circular arc A3. The intermediate part that satisfies the above-described (Formula 1) may be disposed at approximately an intermediate position between the base portion 12*a* and the outside-diameter-side end portion 12*b* of the blade 12. Alternatively, the intermediate part that satisfies the above-described (Formula 1) may be disposed at a position displaced inside in a radial direction with respect to the intermediate position between the base portion 12*a* and the outside-diameter-side end portion 12*b* of the blade 12. Alternatively, the intermediate part that satisfies the above-described (Formula 1) may be disposed at a position displaced outside in the radial direction with respect to the intermediate position between the base portion 12*a* and the outside-diameter-side end portion 12*b* of the blade 12. The intermediate part that satisfies the above-described (Formula 1) is preferred to be positioned outside in the radial direction of the intermediate position between the base portion 12*a* and the outside-diameter-side end portion 12*b* of the blade 12.

According to the above-described configuration, the mounting angle of the intermediate part between the inside diameter side part and the outside diameter side part of the blade 12 is large. This can increase a proportion of an amount of work of the impeller 3 with respect to the power consumption. Accordingly, this can reduce the power consumption while maintaining the cooling performance equal to that of the conventional one.

The following describes further features of the blade 12 of this embodiment. As illustrated in FIG. 3B, the blade 12 includes a rear edge 12*c* having a curved-line cutout shape. The cutout shape of the rear edge 12*c* of the blade 12 is formed by cutting out the rear edge 12*c* in the rotation direction RD so as to satisfy a condition of length of the chord of the intermediate part, which is described below.

A virtual line C indicated by a dashed line in FIG. 3B illustrates an outline of a rear edge of the blade 12 when the above-described cutout shape is not formed. The rear edge 12*c* of the blade 12 of this embodiment has a curved shape such that the rear edge 12*c* gradually separates from the virtual line C, from a side of the base portion 12*a* of the blade 12, from the inside diameter side to the outside diameter side. An inflection point of the above-described curved shape is preferred to be arranged at the position displaced outside in the radial direction with respect to the intermediate position between the base portion 12*a* and the outside-diameter-side end portion 12*b* of the blade 12.

Here, the intermediate part between the inside diameter side part and the outside diameter side part of the blade 12 includes a part where the length of the chord is 80% or less than the length of the chord at the outside diameter side part. The intermediate part between the inside diameter side part and the outside diameter side part of the blade 12 is more preferred to include a part where the length of the chord is 72% to 75% of the length of the chord at the outside diameter side part.

For example, the length of the chord at the position of the virtual circular arc A1 is referred to as a first chord length, the length of the chord at the position of the virtual circular arc A2 is referred to as a second chord length, and the length of the chord at the position of the virtual circular arc A3 is referred to as a third chord length. At this time, this embodiment satisfies a following Formula 2. And, the second chord length is 80% or less than the third chord length, and is preferred to be 72% to 75% of the third chord length.

$$\text{First chord length} \leq \text{Second chord length} < \text{Third chord length} \quad \text{(Formula 2)}$$

According to the above-described configuration, the rear edge 12*c* of the blade 12 has the cutout shape. Furthermore, the length of the chord of the intermediate part between the inside diameter side part and the outside diameter side part of the blade 12 is smaller than that of the conventional one. This configuration enhances rotation efficiency of the impeller 3, and contributes to the increase of the proportion of the amount of work with respect to the power consumption.

Following Table 1 illustrates contents in FIG. 4. This Table 1 indicates numerical values of the mounting angles and the lengths of the chords at the positions of the virtual circular arcs A1 to A3.

TABLE 1

| Position of virtual circular arc | Mounting angle | Length of chord (mm) |
|---|---|---|
| A1 | 41.7° | 25.7 |
| A2 | 42.0° | 30.0 |
| A3 | 38.3° | 40.5 |

In an example in Table 1, the mounting angle of the blade 12 gradationally and slightly increases from the base portion 12*a* of the blade 12 toward the outward in the radial direction. Afterwards, the mounting angle of the blade 12 decreases as approaching the outside-diameter-side end portion 12*b* of the blade 12. Accordingly, the mounting angle of the intermediate part between the inside diameter side part and the outside diameter side part (here, the part corresponding to the virtual circular arc A2) of the blade 12 is preferred to be larger than the mounting angle of the inside diameter side part (the part corresponding to the virtual circular arc A1) of the blade 12, and larger than the mounting angle of the outside diameter side part (the part corresponding to the virtual circular arc A3). The blade 12 has the intermediate part (the part corresponding to the virtual circular arc A2) between the inside diameter side part and the outside diameter side part of the blade 12. As illustrated in Table 1, the length of the chord of the intermediate part is preferred to be longer than the length of the chord of the inside diameter side part, and about 74% of the length of the chord of the outside diameter side part.

Figure 5A:
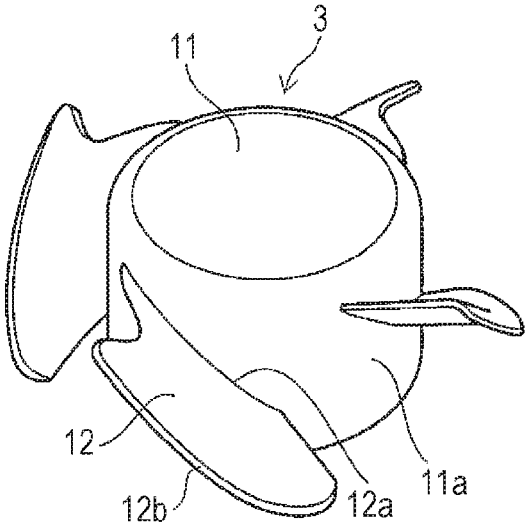
FIG. 5A is a perspective view of a second exemplary impeller in the axial blower of the first embodiment.
Figure 5B:
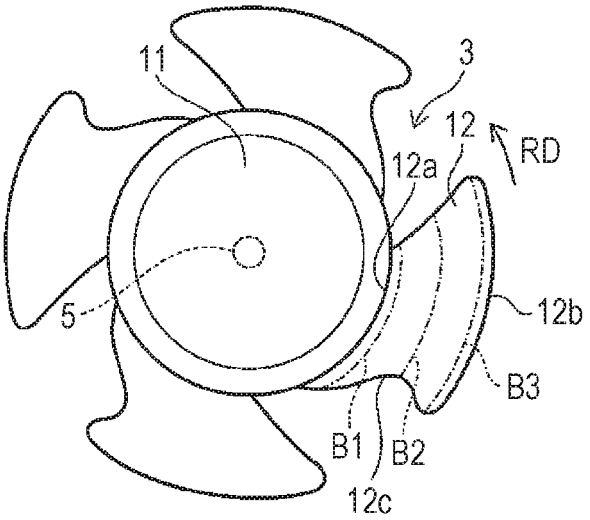
FIG. 5B is a plan view of the second exemplary impeller in the axial blower of the first embodiment.

FIG. 5A is a perspective view of a second example of the impeller 3. FIG. 5B is a plan view of the impeller 3 in FIG. 5A. The impeller 3 includes the hub 11 including the peripheral wall portion 11*a*, and the four blades 12. The base portions 12*a* of the four blades 12 are secured to the peripheral wall portion 11*a* of the hub 11. The four blades 12 extend from the peripheral wall portion 11*a* of the hub 11 to the outside in the radial direction of the peripheral wall portion 11*a*. Furthermore, the four blades 12 are disposed in the circumferential direction of the peripheral wall portion 11*a* at a regular interval.

Here, it is assumed that virtual circular arcs center the rotation shaft 5 of the impeller 3. Virtual circular arcs B1, B2, and B3, which are disposed from the inside diameter side to the outside diameter side of the blade 12, are defined as illustrated in FIG. 5B. That is, the virtual circular arc B1 is positioned at the inside diameter side of the blade 12. The virtual circular arc B1 is, for example, positioned at the proximity of the base portion 12*a* of the blade 12. The virtual circular arc B3 is positioned at the outside diameter side of the blade 12. The virtual circular arc B3 is, for example, positioned at the proximity of the outside-diameter-side end portion 12*b* of the blade 12. The virtual circular arc B2 is positioned between the virtual circular arc B1 and the virtual circular arc B3.

Figure 6:
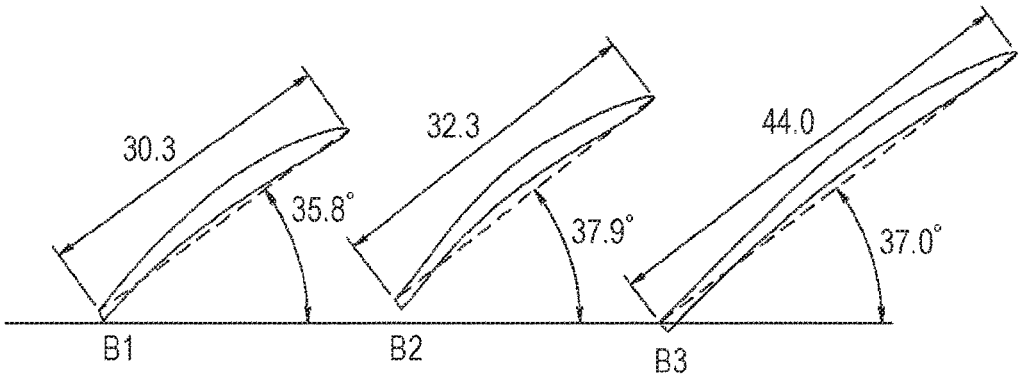
FIG. 6 are cross-sectional views of a blade cut at positions of virtual circular arcs in FIG. 5B by virtual cylindrical surfaces.

FIG. 6 are cross-sectional views of the blade 12 cut at positions of the virtual circular arcs B1 to B3 in FIG. 5B by virtual cylindrical surfaces. Here, the cross-sectional surfaces illustrated in FIG. 6, similarly to that in FIG. 4, are that cross-sectional surfaces of the blade 12 cut at the positions of the virtual circular arcs B1 to B3 by the virtual cylindrical surfaces centering the rotation shaft 5 of the impeller 3 are projected in a planar surface.

Numerical values of the mounting angles and the lengths of the chords at the positions of the virtual circular arcs B1 to B3 of the impeller 3 illustrated in FIG. 6 are indicated in following Table 2.

TABLE 2

| Position of virtual circular arc | Mounting angle | Length of chord (mm) |
|---|---|---|
| B1 | 35.8° | 30.3 |
| B2 | 37.9° | 32.3 |
| B3 | 37.0° | 44.0 |

As illustrated in an example in Table 2, the mounting angle of the intermediate part between the inside diameter side part and the outside diameter side part (here, a part corresponding to the virtual circular arc B2) of the blade 12 is preferred to be larger than the mounting angle of the inside diameter side part (a part corresponding to the virtual circular arc B1) of the blade 12, and larger than the mounting angle of the outside diameter side part (a part corresponding to the virtual circular arc B3).

As illustrated in FIG. 5B, the rear edge 12*c* of the blade 12 has the curved-line cutout shape. According to this configuration, the blade 12 has the intermediate part (the part corresponding to the virtual circular arc B2) between the inside diameter side part and the outside diameter side part of the blade 12. As illustrated in Table 2, the length of the chord of the intermediate part is preferred to be longer than the length of the chord of the inside diameter side part, and about 73% of the length of the chord of the outside diameter side part.

The above-described example can reduce the power consumption while maintaining the cooling performance equal to that of the conventional one (that is, the air volume-static pressure characteristics equal to that of the conventional one).

The mounting angle of the blade 12 is not limited to the examples in Tables 1 and 2. The mounting angle of the blade 12 of the impeller 3 may be set to various angles, and, for example, may be set in a range of 24° to 62°, in accordance with usage and the like of this impeller. Even when the mounting angle is set in such angle range, if the mounting angle satisfies the relation in the above-described (Formula 1), the advantageous effects of this embodiment can be obtained.

Second Embodiment

Figure 7A:
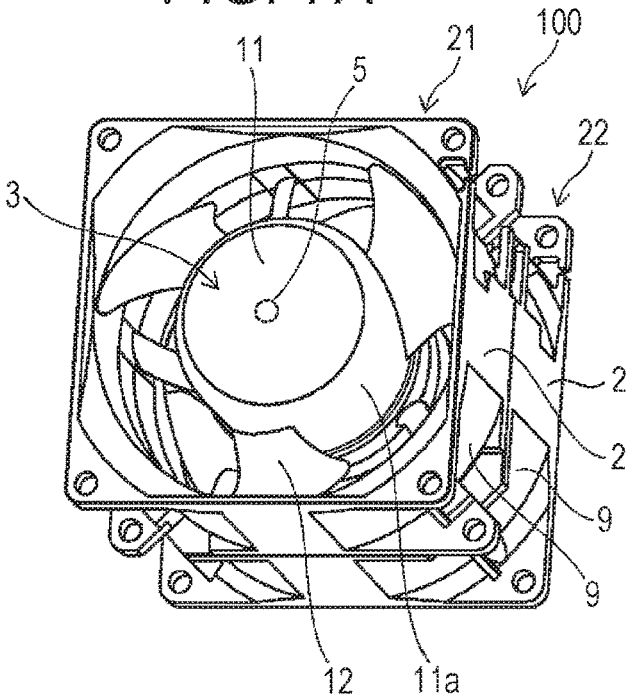
FIG. 7A is a perspective view where a series-type axial blower of a second embodiment is viewed from an air intake side.
Figure 7B:
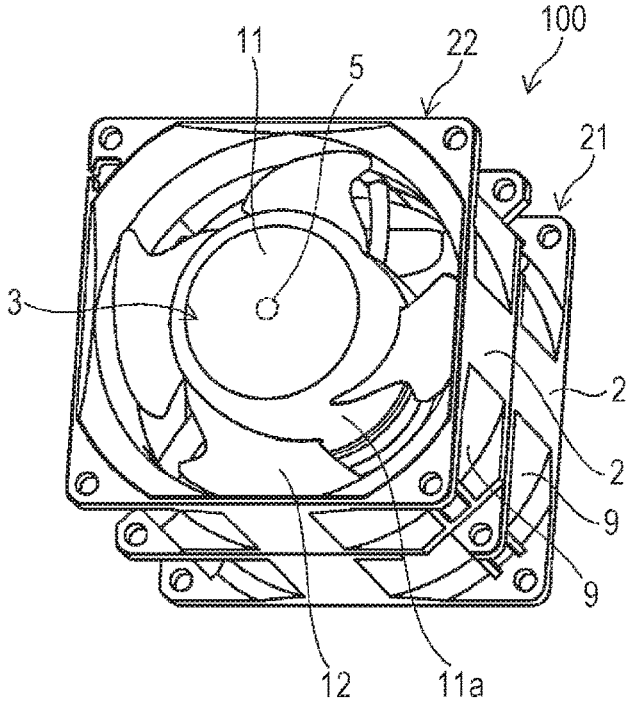
FIG. 7B is a perspective view where the series-type axial blower of the second embodiment is viewed from a discharge side.
Figure 8:
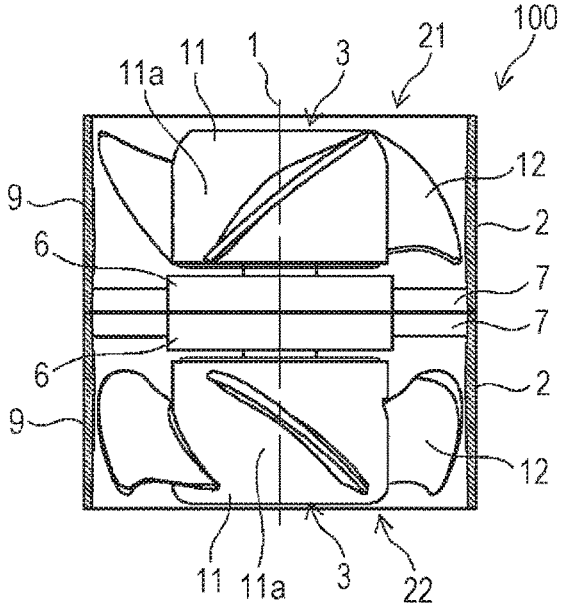
FIG. 8 is a cross-sectional view of the series-type axial blower of the second embodiment.

Next, the following describes a series-type axial blower (a double-inversion-type axial blower) according to a second embodiment of this disclosure in detail. FIG. 7A is a perspective view where the series-type axial blower of the second embodiment is viewed from an air intake side. FIG. 7B is a perspective view where the series-type axial blower of the second embodiment is viewed from a discharge side. FIG. 8 is a cross-sectional view of the series-type axial blower of the second embodiment. When describing this embodiment, like reference numerals designate substantially identical elements to those of the above-described embodiment, and therefore repeated descriptions will be omitted as possible.

A series-type axial blower 100 according to this embodiment includes a first axial blower 21 and a second axial blower 22. At the series-type axial blower 100, the first axial blower 21 and the second axial blower 22 are coupled in series in an axial direction of the rotation shaft 5 of a motor. The first axial blower 21 is arranged at the air intake side. The second axial blower 22 is arranged at the discharge side. That is, at the series-type axial blower 100 in FIG. 8, flow of air along a central axis 1 occurs so that air is incorporated from an upper side of the first axial blower 21, and the air is delivered to a lower side of the second axial blower 22. In this embodiment, the two axial blowers 21 and 22 are coupled in series. This embodiment is not limited to this. The three or more axial blowers may be coupled in series.

In this example, the first axial blower 21 has a configuration illustrated in FIGS. 1A, 1B, and 2. The second axial blower 22 has a structure approximately similar to the structure that the first axial blower 21 is inverted in a vertical direction. At the series-type axial blower 100 of this embodiment, the two fan housings 2 and 2 including the cylindrically-shaped pipe portions 9 are coupled in series. Thus, the impeller 3 of the first axial blower 21 and the impeller 3 of the second axial blower 22 are sequentially arranged along an airflow direction. The impeller 3 of the second axial blower 22 rotates in an opposite direction of the rotation direction of the impeller 3 of the first axial blower 21, around the rotation shaft 5 by a rotatably drive of a motor (not illustrated). Thus, the impeller 3 of the second axial blower 22 generates air flow in an identical direction to air flow in a direction of the central axis 1 that is generated by rotation of the impeller 3 of the first axial blower 21. The air is delivered below the series-type axial blower 100.

In this embodiment, the impeller 3 of the first axial blower 21 has a structure similar to the structure illustrated in FIGS. 3A, 3B, and 4. The impeller 3 of the second axial blower 22 has a structure similar to the structure illustrated in FIGS. 5A, 5B, and 6. Accordingly, in this embodiment, the number of the blade 12 of the impeller 3 of the first axial blower 21 is three, and the number of the blade 12 of the impeller 3 of the second axial blower 22 is four. Relations of the mounting angles and relations of the lengths of the chords at the impeller 3 of the first axial blower 21 and the impeller 3 of the second axial blower 22 are as illustrated in FIGS. 4 and 6 respectively.

As described above, in this embodiment, the mounting angle of the intermediate part (for example, the part corresponding to the virtual circular arc A2) at the blade 12 of the impeller 3 of the first axial blower 21 disposed at the air intake side is larger than the mounting angle of the intermediate part (for example, the part corresponding to the virtual circular arc B2) at the blade 12 of the impeller 3 of the second axial blower 22 disposed at the discharge side. At the first axial blower 21 disposed at the air intake side, the mounting angle of the blade 12 is preferred to be set larger than that at the discharge side in order to incorporate more air. At the second axial blower 22 disposed at the discharge side, the mounting angle of the blade 12 is preferred to be set smaller than that at the air intake side in order to increase pressure.

Figure 9:
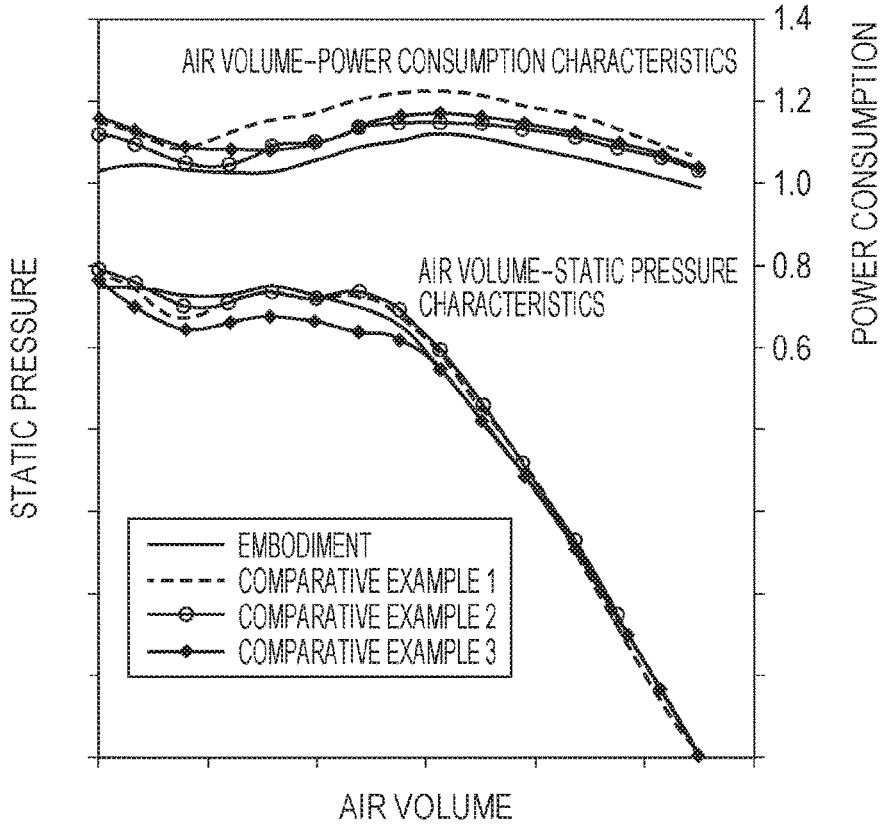
FIG. 9 illustrates air volume-static pressure characteristics and air volume-power consumption characteristics regarding the series-type axial blower of the second embodiment and series-type axial blowers of comparative examples 1 to 3.

Next, the following describes test result in order to confirm effect of the axial blower according to the above-described embodiments. FIG. 9 illustrates the air volume-static pressure characteristics and the air volume-power consumption characteristics regarding the series-type axial blower 100 of the second embodiment and series-type axial blowers of a plurality of comparative examples. In FIG. 9, numerical values of the power consumption are indicated with exponent notations when a certain value is 1 (for example, a standardized value).

At this test, comparative examples 1 to 3 are prepared. The comparative examples 1 to 3 are series-type axial blowers similar to the series-type axial blower 100 of the second embodiment. In the comparative examples 1 to 3, first axial blowers disposed at the air intake side and second axial blowers disposed at the discharge side are coupled in series. In the comparative examples 1 to 3, impellers of the first axial blowers at the air intake side each include three blades. Impellers of the second axial blowers at the discharge side each include four blades.

Figure 11A:
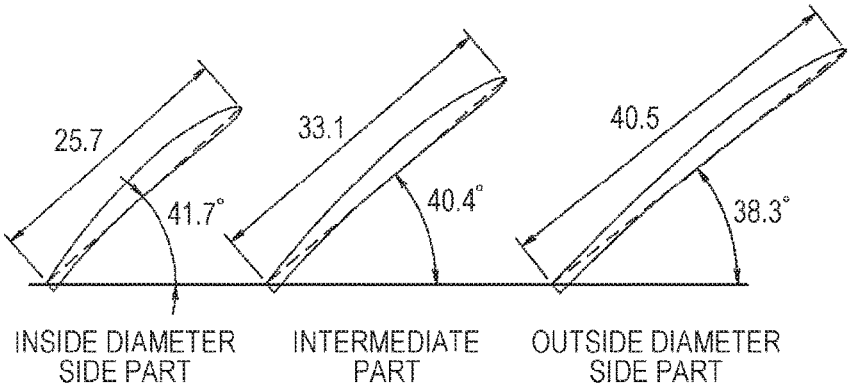
FIG. 11A are cross-sectional views of a blade of a first axial blower disposed at an air intake side of the series-type axial blower of the comparative example 1.
Figure 11B:
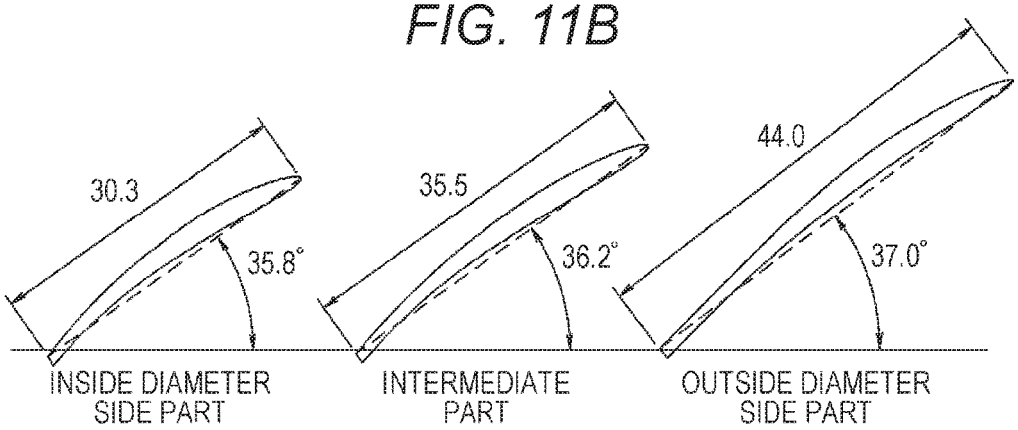
FIG. 11B are cross-sectional views of a blade of a second axial blower disposed at a discharge side of the series-type axial blower of the comparative example 1.
Figure 12A:
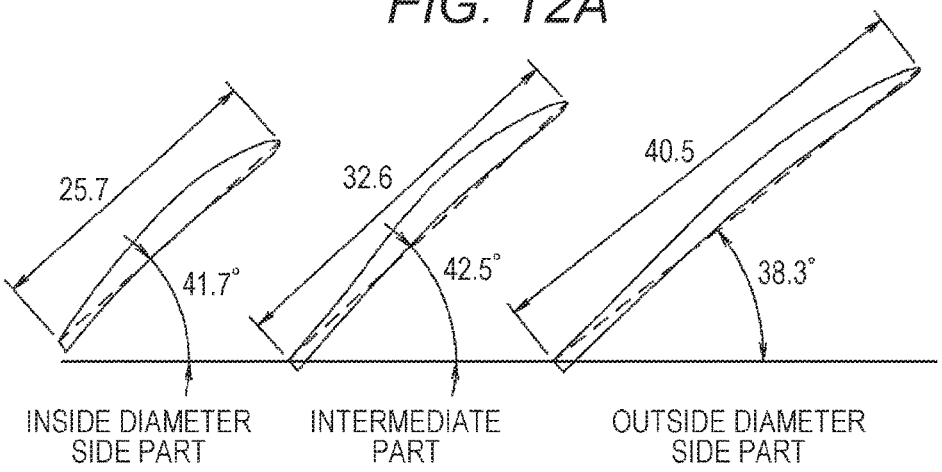
FIG. 12A are cross-sectional views of a blade of a first axial blower disposed at an air intake side of the series-type axial blower of the comparative example 2.
Figure 12B:
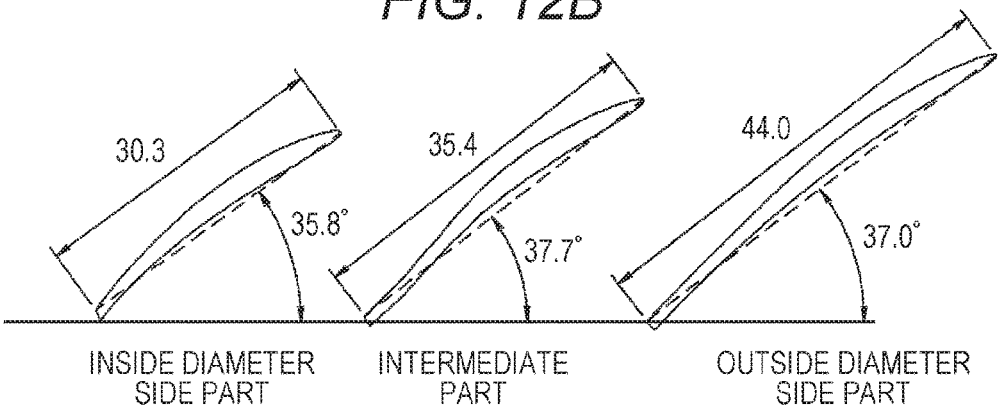
FIG. 12B are cross-sectional views of a blade of a second axial blower disposed at a discharge side of the series-type axial blower of the comparative example 2.
Figure 13A:
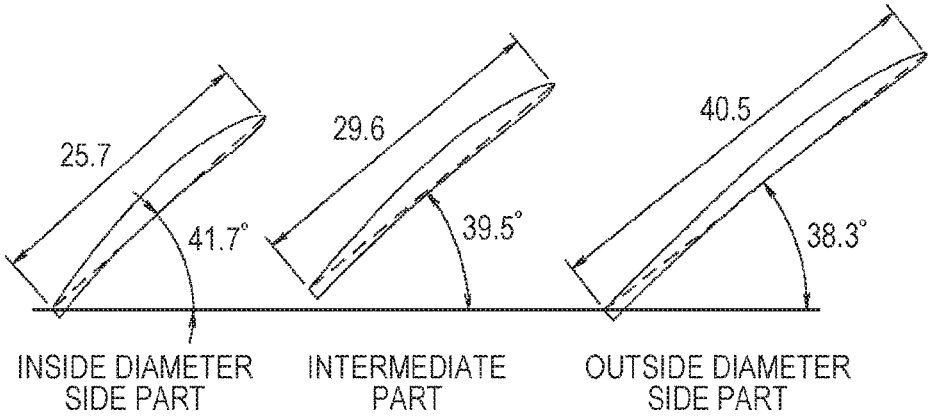
FIG. 13A are cross-sectional views of a blade of a first axial blower disposed at an air intake side of the series-type axial blower of the comparative example 3.
Figure 13B:
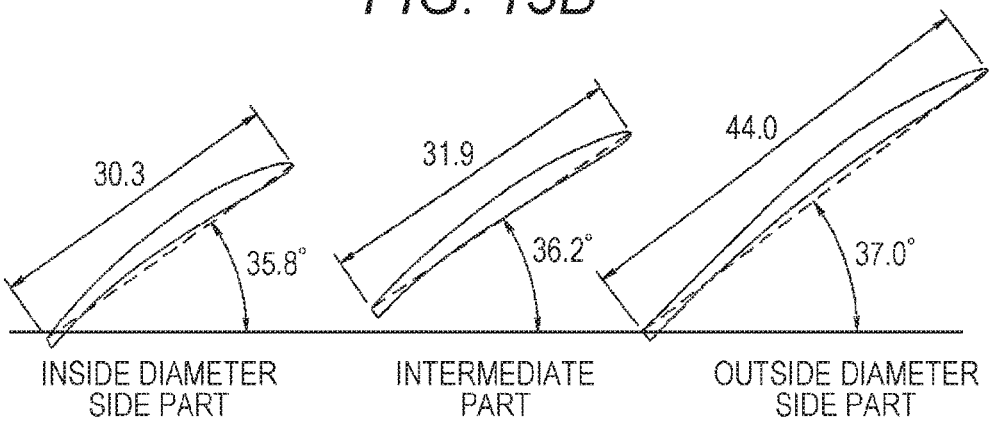
FIG. 13B are cross-sectional views of a blade of a second axial blower disposed at a discharge side of the series-type axial blower of the comparative example 3.

FIGS. 11A, 11B, 12A, 12B, 13A, and 13B illustrate mounting angles and lengths of the chords (the unit is mm) of the blades of the comparative examples 1 to 3. Specifically, FIG. 11A are cross-sectional views of the blade of the first axial blower at the air intake side of the comparative example 1. FIG. 11B are cross-sectional views of the blade of the second axial blower at the discharge side of the comparative example 1. FIG. 12A are cross-sectional views of the blade of the first axial blower at the air intake side of the comparative example 2. FIG. 12B are cross-sectional views of the blade of the second axial blower at the discharge side of the comparative example 2. FIG. 13A are cross-sectional views of the blade of the first axial blower at the air intake side of the comparative example 3. FIG. 13B are cross-sectional views of the blade of the second axial blower at the discharge side of the comparative example 3. In these drawings, cross-sectional surfaces of the blades cut at inside diameter side parts, intermediate parts, and outside diameter side parts of the blades by virtual cylindrical surfaces centering rotation shafts of the impellers are projected in planar surfaces. In the comparative examples 1 to 3, the inside diameter side parts, the intermediate parts, and the outside diameter side parts of the blades are the parts corresponding to A1, A2, and A3 in FIG. 3B respectively in a case of the blades of the first axial blowers disposed at the air intake side. In a case of the blades of the second axial blowers disposed at the discharge side, the inside diameter side parts, the intermediate parts, and the outside diameter side parts of the blades are the parts corresponding to B1, B2, and B3 in FIG. 5B respectively.

In the comparative example 1, the above-described (Formula 1) is not satisfied, and a rear edge of the blade does not have the cutout shape. As illustrated in FIG. 11A, at the first axial blower, the mounting angle of the blade gradually decreases from a base portion of the blade toward an outward in a radial direction. As illustrated in FIG. 11B, at the second axial blower, the mounting angle of the blade gradually increases from a base portion of the blade toward an outward in a radial direction. Since the rear edge of the blade does not have the cutout shape, the length of the chord of the intermediate part is about 81% to 82% of the length of the chord of the outside diameter side part.

In the comparative example 2, the above-described (Formula 1) is satisfied. In view of this, the comparative example 2 can be said to be one embodiment in this disclosure. However, in the comparative example 2, the length of the chord of the intermediate part of the blade is not extremely shortened (that is, the blade does not have a deep cutout shape as in this embodiment). As illustrated in FIG. 12A, at the first axial blower, the mounting angle of the intermediate part of the blade is larger than the mounting angle of the inside diameter side part, and larger than the mounting angle of the outside diameter side part. As illustrated in FIG. 12B, even for the second axial blower, the mounting angle of the intermediate part of the blade is larger than the mounting angle of the inside diameter side part, and larger than the mounting angle of the outside diameter side part. The length of the chord of the intermediate part of the blade is about 80% of the length of the chord of the outside diameter side part.

In the comparative example 3, the above-described (Formula 1) is not satisfied. However, in the comparative example 3, a rear edge of the blade has the cutout shape. In view of this, the comparative example 3 can be said to be one embodiment in this disclosure. As illustrated in FIG. 13A, at the first axial blower, the mounting angle of the blade gradually decreases from a base portion of the blade toward an outward in a radial direction. As illustrated in FIG. 13B, at the second axial blower, the mounting angle of the blade gradually increases from a base portion of the blade toward an outward in a radial direction. The rear edge of the blade has the cutout shape. In view of this, the length of the chord of the intermediate part is about 73% of the length of the chord of the outside diameter side part.

As illustrated in FIG. 9, this embodiment can reduce the power consumption while maintaining the air volume-static pressure characteristics equal to those of the comparative examples 1 to 3. For example, this embodiment has effect that restrains about 7% of the power consumption compared with the comparative example 1. When comparing the comparative example 1 with the comparative examples 2 and 3, the comparative examples 2 and 3 can restrain the power consumption more than the comparative example 1. In the comparative example 2, the above-described (Formula 1) is satisfied, and the blade does not have the deep cutout shape. It is found that even such configuration has a restraining effect of the power consumption compared with the comparative example 1.

In the comparative example 3, the rear edge of the blade has the cutout shape. In view of this, the length of the chord of the intermediate part of the blade is configured to be shorter than the length of the chord of the outside diameter side part. It is found that even this comparative example 3 has the restraining effect of the power consumption compared with the comparative example 1. As illustrated in the test result in FIG. 9, the most effective configuration is that of this embodiment that satisfies the above-described (Formula 1) and the rear edge of the blade has the cutout shape. This embodiment has effect that can restrain about 5% of the power consumption even if comparing with the comparative examples 2 and 3. FIG. 9 is the test result at the series-type axial blower including two axial blowers. However, even when using the axial blower alone, similar power consumption restraining effect can be expected.

Figure 10:
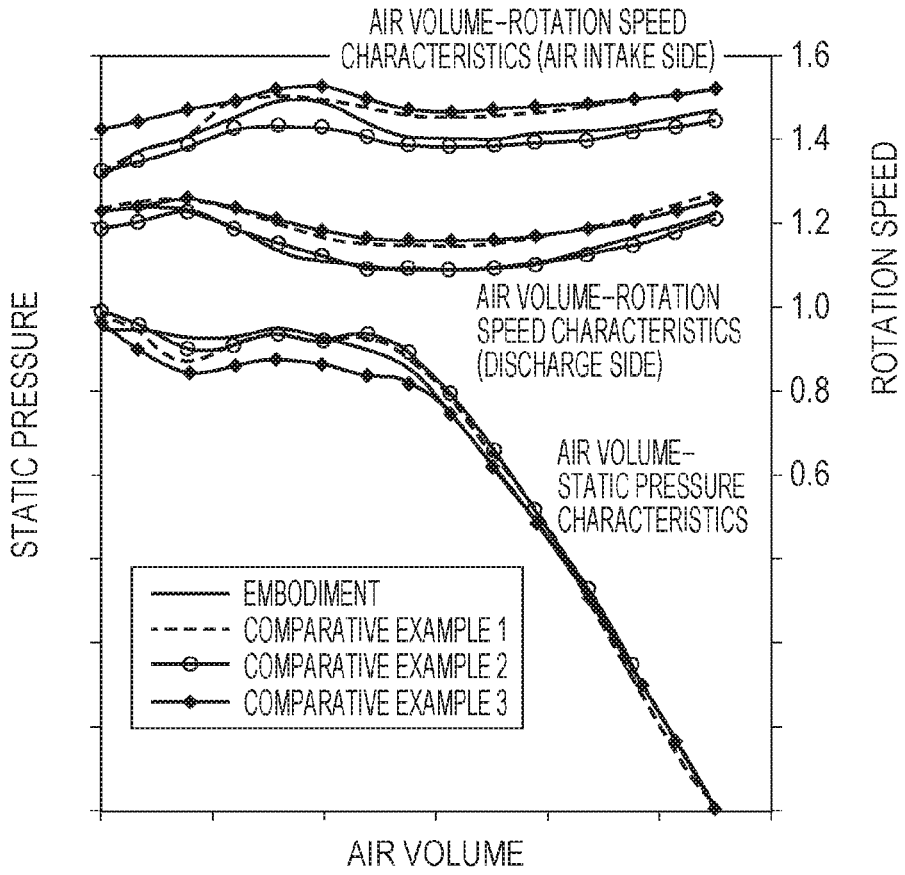
FIG. 10 illustrates the air volume-static pressure characteristics and air volume-rotation speed characteristics regarding the series-type axial blower of the second embodiment and the series-type axial blowers of the comparative examples 1 to 3.

FIG. 10 is a diagram illustrating the air volume-static pressure characteristics and the air volume-rotation speed characteristics regarding the series-type axial blower 100 of the second embodiment and the series-type axial blowers of the comparative examples 1 to 3. In FIG. 10, the upper side graph of the air volume-rotation speed characteristics illustrates the air volume-rotation speed characteristics of the first axial blower disposed at the air intake side of the series-type axial blower. The lower side graph of the air volume-rotation speed characteristics illustrates the air volume-rotation speed characteristics of the second axial blower disposed at the discharge side of the series-type axial blower. In FIG. 10, numerical values of the rotation speed are indicated with exponent notations when a certain value is 1 (for example, a standardized value).

As illustrated in FIG. 10, this embodiment also provide effect that decreases about 5% of the rotation speed compared with the comparative examples 1 and 3. The rotation speed of this embodiment may be similar to that of the comparative example 2, or not advantageous compared with the comparative example 2. However, as illustrated in FIG. 9, the power consumption of this embodiment is substantially improved. Accordingly, it is found that this embodiment is effective.

The technique of this disclosure is not limited to the above-described embodiments, and includes various modifications. The above-described embodiments are described in detail in order to describe comprehensibly the technique of this disclosure. The technique of this disclosure is not necessarily limited to the configuration including all the described configurations. A part of the configuration of one embodiment can be replaced to the configuration of other embodiment. To the configuration of one embodiment, the configuration of other embodiment can be applied. To the respective embodiments, other configuration can be applied. Furthermore, a part of the respective embodiments can be removed or changed to other configuration.

In the above explanation, expression such as "all", "perpendicular", "straight line", "constant", and "center" are not intended to be strictly interpreted. That is, these expressions allow tolerance and error in design and in manufacturing, the respective expressions mean "substantially all", "substantially perpendicular", "substantially straight line", "substantially constant", and "substantially center".

The rear edge 12*c* of the blade 12 may have a curved shape as gradually separating from the virtual line C, from the inside diameter side to the outside diameter side.

The axial blower and the series-type axial blower according to the embodiments may be following first to third axial blowers and first and second series-type axial blowers.

The first axial blower is characterized by including a housing including a wind tunnel, an impeller that is disposed in the wind tunnel and includes a plurality of blades, and a motor that includes a rotation shaft and is secured to the housing, and the impeller is secured to the rotation shaft, and when an angle between a chord of the blade at a cross-sectional surface when cutting the blade by a virtual cylindrical surface centering the rotation shaft, and a surface perpendicular to the rotation shaft is defined as a mounting angle, the blade includes an intermediate part that has a mounting angle equal to or larger than a mounting angle of an inside diameter side part, and larger than a mounting angle of an outside diameter side part, between the inside diameter side part and the outside diameter side part of the blade.

The second axial blower is the first axial blower characterized in that the blade includes a rear edge having a cutout shape, and the intermediate part includes a part where a length of the chord is 80% or less than a length of the chord of the outside diameter side part.

The third axial blower is the second axial blower characterized in that the intermediate part includes a part where the length of the chord is 72% to 75% of the length of the chord of the outside diameter side part.

The first series-type axial blower is characterized by including the plurality of any one of first to third axial blowers, and coupling the plurality of axial blowers in series in an axial direction of the rotation shaft.

The second series-type axial blower is the first series-type axial blower characterized in that the mounting angle of the intermediate part at the axial blower disposed at an air intake side is larger than the mounting angle of the intermediate part at the axial blower disposed at a discharge side.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An axial blower comprising:

a housing including a wind tunnel;

an impeller that is disposed in the wind tunnel and includes a plurality of blades;

and a motor that includes a rotation shaft and is secured to the housing, the impeller being secured to the rotation shaft, wherein when an angle between a chord of the blade at a cross-sectional surface of the blade cut by a virtual cylindrical surface centering the rotation shaft, and a surface perpendicular to the rotation shaft is defined as a mounting angle, the blade includes an intermediate part between an inside diameter side part and an outside diameter side part of the blade, and this intermediate part has a mounting angle equal to or larger than a mounting angle of the inside diameter side part, and larger than a mounting angle of the outside diameter side part, the blade includes a rear edge having a cutout shape, and the intermediate part includes a portion where a length of the chord is from 80% to 72% of a length of the chord of the outside diameter side part;

the blade further includes a front edge having a cutout shape, and when viewed in a direction parallel with an axial direction of the rotation shaft the cutout shape of the rear edge is concave toward a rotation direction of the impeller and the cutout shape of the front edge is concave toward a direction opposite to the rotation direction of the impeller.

2. The axial blower comprising:

a plurality of the axial blowers according to claim 1, wherein the plurality of axial blowers being coupled in series in an axial direction of the rotation shaft.

3. The axial blower according to claim 2, wherein the mounting angle of the intermediate part at the axial blower disposed at an air intake side is larger than the mounting angle of the intermediate part at the axial blower disposed at a discharge side.

* * * * *